US011813666B2

(12) United States Patent
Wöstmann et al.

(10) Patent No.: US 11,813,666 B2
(45) Date of Patent: Nov. 14, 2023

(54) CASTING CORE FOR CASTING MOLDS AND METHOD FOR THE PRODUCTION OF SAME

(71) Applicant: Fraunhofer-Gesellschaft zur Förderung der angewandten Forschung e.V., Munich (DE)

(72) Inventors: Franz-Josef Wöstmann, Bremen (DE); Lukas Stumm, Bremen (DE); Christian Soltmann, Bremen (DE); Matthias Busse, Bremen (DE)

(73) Assignee: Fraunhofer-Gesellschaft zur Förderung der angewandten Forschung e. V., Munich (DE)

( * ) Notice: Subject to any disclaimer, the term of this patent is extended or adjusted under 35 U.S.C. 154(b) by 194 days.

(21) Appl. No.: 17/250,870

(22) PCT Filed: Sep. 19, 2019

(86) PCT No.: PCT/EP2019/075154
§ 371 (c)(1),
(2) Date: Mar. 16, 2021

(87) PCT Pub. No.: WO2020/058394
PCT Pub. Date: Mar. 26, 2020

(65) Prior Publication Data

US 2022/0048100 A1 Feb. 17, 2022

(30) Foreign Application Priority Data

Sep. 19, 2018 (DE) ..... 10 2018 215 962.9

(51) Int. Cl.
*B22C 9/10* (2006.01)
*B22C 1/02* (2006.01)

(52) U.S. Cl.
CPC . *B22C 9/10* (2013.01); *B22C 1/02* (2013.01)

(58) Field of Classification Search
CPC .... B22C 1/00; B22C 1/02; B22C 1/18; B22C 1/181; B22C 1/185; B22C 1/186; B22C 1/20; B22C 9/10
USPC ..... 164/369, 520, 525, 528; 249/175
See application file for complete search history.

(56) References Cited

U.S. PATENT DOCUMENTS

| | | | |
|---|---|---|---|
| 4,093,017 | A | 6/1978 | Miller, Jr. et al. |
| 4,162,238 | A | 7/1979 | Bergna |
| 4,184,885 | A | 1/1980 | Klug et al. |
| 4,190,450 | A | 2/1980 | Burd et al. |
| 4,905,750 | A | 3/1990 | Wolf |

FOREIGN PATENT DOCUMENTS

| | | | |
|---|---|---|---|
| CN | 101716650 | | 6/2010 |
| CN | 105499480 | | 4/2016 |
| CN | 107052254 | | 8/2017 |
| CN | 108080575 | | 5/2018 |
| CN | 108484140 | | 9/2018 |
| DE | 3036436.1 | C2 | 9/1990 |
| EP | 2937161 | A1 | 10/2015 |
| EP | 3150298 | A1 | 4/2017 |
| JP | 61103646 | | 5/1986 |

OTHER PUBLICATIONS

"Chinese Application Serial No. 201980073167.1 , Office Action dated May 9, 2022", w Concise Statement of Relevance, (May 9, 2022), 7 pgs.
"Chinese Application Serial No. 201980073167.1 , Search Report dated May 1, 2022", (May 1, 2022), 3 pgs.
"German Application Serial No. 10 2018 215 962.9, Office Action dated Aug. 13, 2019", (Aug. 13, 2019), 6 pgs.
"International Application Serial No. PCT/EP2019/075154, International Search Report dated Nov. 27, 2019", w/ English Translation, (Nov. 27, 2019), 7 pgs.
"International Application Serial No. PCT/EP2019/075154, Written Opinion dated Nov. 27, 2019", (Nov. 27, 2019), 5 pgs.

*Primary Examiner* — Kevin P Kerns
(74) *Attorney, Agent, or Firm* — Schwegman Lundberg & Woessner, P.A.

(57) ABSTRACT

A casting core for casting moulds can include a central core and a core shroud arranged around the central core. The core shroud containing contains or consists of ceramic particles bound to a binder. The central core contains ceramic particles bound to a binder, wherein the ceramic particles of the central core contain at least one component, which exhibits, at a temperature in a range from 100° C. to 1500° C., a thermally induced phase transformation, and/ or at least two components, the thermal expansion coefficients of which at 20° C. differ by at least $5 \cdot 10^{-6} K^{-1}$.

23 Claims, No Drawings

CASTING CORE FOR CASTING MOLDS AND METHOD FOR THE PRODUCTION OF SAME

PRIORITY APPLICATIONS

This application is a U.S. National Stage Filing under 35 U.S.C. §371 from International Application No. PCT/EP2019/075154, filed on Sep. 19, 2019, and published as WO2020/058394 on Mar. 26, 2020, which claims the benefit of priority to German Application No. 10 2018 215 962.9, filed on Sep. 19, 2018; the benefit of priority of each of which is hereby claimed herein, and which applications and publication are hereby incorporated herein by reference in their entirety.

The present invention relates to a casting core for casting molds, wherein the casting core comprises an inner core and an outer core arranged around the inner core. The outer core comprises or consists of ceramic particles bound by way of a binder. The inner core comprises or consists of ceramic particles bound by way of a binder, wherein the ceramic particles of the inner core comprise or consist of

- at least one component that has a thermally induced phase change at a temperature in a range of 100° C. to 1500° C.; and/or
- at least two components having coefficients of thermal expansion that, at 20° C., differ from one another by at least $5 \cdot 10^{-6}$ $K^{-1}$.

The present disclosure additionally relates to a method for producing the casting core according to the disclosure and to the use of the casting core according to the disclosure.

BACKGROUND

Casting cores or cores are used in molds when casting components so as to create cavities, channels or undercuts that are provided in what will later be the component. For this purpose, the casting cores should have the necessary strength and remain dimensionally stable during the casting process. Infiltration of the cores by molten material, breaking, deformation or outgassing during casting at increased pressure must be precluded. So as to yield a favorable cast surface, additional requirements exist with regard to the core material. As little wetting as possible between the melt and the core and a smooth, chemically suitable surface are advantageous. It is furthermore necessary for cores that are used to produce a complex inner geometry to be easily destructible. For this purpose, good disintegratability is advantageous so as to ensure removal of the core material from the component after casting.

To produce cores, usually refractory fillers or ceramic particles (such as silica sand, zircon sand, aluminosilicates) comprising organic or inorganic binders are brought into the desired shape. This can take place by way of pressing, core shooting or pouring. With organic binders, curing can be achieved, for example in the cold box process, by way of a reaction with a gaseous component that is fed. In the case of hot box processes, a reaction of the binder components (for example phenolic resin-based or furan resin-based) can be enabled by applying heat. Inorganic alkali sodium silicate-based binders can be solidified by introducing $CO_2$ into the mold body. Additional options include self-curing binders based on phosphate, gypsum, cement or silica. The thermal decomposition of the organic binders during the casting process weakens the core microstructure and allows the core material to be removed from the casting, but is also associated with the emission of gases harmful to the environment. In the case of thick-walled components, it is possible that the added heat is not enough to sufficiently decompose the binder in the core interior for easy demolding. The gas development can also be problematic for the casting process. The used core sands can generally not be reused and have to be disposed of as hazardous waste. Deformability after casting is more critical in the case of inorganic binder systems since the cohesion of the material is not weakened by thermal decomposition of the binder phase. Moreover, high temperatures can result in onsetting sintering, thereby making core removal later more difficult.

DETAILED DESCRIPTION

Disclosed herein is a casting core that, on the one hand, remains dimensionally stable during the casting process and, on the other hand, can be easily removed from the cast component after the casting process.

According to the present disclosure, a casting core for casting molds is thus provided, comprising an inner core and an outer core arranged around the inner core. The outer core comprises or consists of ceramic particles bound by way of a binder. The inner core comprises or consists of ceramic particles bound by way of a binder, wherein the ceramic particles of the inner core comprise or consist of

- at least one component that has a thermally induced phase change at a temperature in a range of 100° C. to 1500° C., preferably of 150° C. to 1000° C., particularly preferably of 200° C. to 600° C., and/or
- at least two components having coefficients of thermal expansion that, at 20° C., differ from one another by at least $5 \cdot 10^{-6}$ $K^{-1}$, preferably by at least $8 \cdot 10^{-6}$ $K^{-1}$, and particularly preferably by at least $11 \cdot 10^{-6} K^{-1}$.

The coefficient of thermal expansion or the coefficients of thermal expansion can be determined according to DIN 51045. It is also possible for all other coefficients of thermal expansion provided in the present patent application to be determined in this way.

The casting core according to the invention advantageously comprises multiple parts, namely an inner part, this being the inner core, and an outer part, this being the outer core. As a result of this core design comprising an outer core, which is in contact with the melt, and an inner core, the casting core according to the invention is optimally adapted to the different requirements during and after a casting process.

As a result of the presence of

- at least one component that has a thermally induced phase change at a temperature in a range of 100° C. to 1500° C.; and/or
- at least two components having coefficients of thermal expansion that, at 20° C., differ from one another by at least $5 \cdot 10^{-6}$ $K^{-1}$ in the inner core, the inner core can be destabilized by thermal loading, thereby simplifying the removal of the casting core from the casting. Due to the heat input during the casting process, which, for example, has a temperature in a range of 100° C. to 1500° C.,
- the at least one component that has a thermally induced phase change at a temperature in a range of 100° C. to 1500° C. undergoes a phase change, thereby suddenly changing the volume thereof (volume jump) and/or
- the at least two components having coefficients of thermal expansion that, at 20° C., differ from one another by at least $5 \cdot 10^{-6}$ $K^{-1}$ expand to differing degrees.

Due to the volume jump of the at least one described component and/or the differing expansions of the at least two described components, the material cohesion of the inner core is weakened, thereby simplifying the removal of the casting core. In other words, gaps or cavities arise in the locations in which volume changes occur due to the heat input, making the inner core porous or unstable. This instability then simplifies the removal of the casting core. Since, however, the at least one component having the phase change is or the at least two components having the differing coefficients of thermal expansion are only arranged in the inner core, and not in the outer core, the outer core or the casting core has a dense and mechanically strong surface that is suitable for the contact with the melt during the casting process, which is why the casting core remains dimensionally stable during the casting process.

Due to the core design comprising an outer core, which is in contact with the melt during the casting process, and an inner core, the functionality of the material composition in the different core regions can be adapted to opposing requirements. It is possible, for example, to use fillers or ceramic particles in the outer core, which have little interaction with the melt. Lower porosity and higher mechanical strength can also be provided in this outer core layer. By way of the fillers or ceramic particles that are used, the thermal properties can be selected in the outer core in such a way that a time-delayed destabilization of the inner core takes place as a function of the casting temperature and the amount of heat that is applied. With this decoupling, high process reliability and a favorable casting quality can be achieved. When organic binders are dispensed with, partial reusability or uncomplicated disposal is ensured.

The ceramic particles of the inner core are preferably composed of

- at least one component that has a thermally induced phase change at a temperature in a range of 100° C. to 1500° C.; and/or
- at least two components having coefficients of thermal expansion that, at 20° C., differ from one another by at least $5\cdot10^{-6}K^{-1}$.

Preferably, the outer core of the casting core does not comprise any component that has a thermally induced phase change at a temperature in a range of 100° C. to 1500° C., preferably of 150° C. to 1000° C., and particularly preferably of 200° C. to 600° C.

Preferably, the outer core of the casting core does not comprise two components having coefficients of thermal expansion that, at 20° C., differ from one another by at least $5\cdot10^{-6}K^{-1}$, preferably by at least $8\cdot10^{-6}K^{-1}$, and particularly preferably by at least $11\cdot10^{-6}$ $K^{-1}$.

A preferred embodiment of the casting core according to the invention is characterized in that the ceramic particles of the outer core are selected from the group consisting of zircon sand particles, aluminosilicate particles, mullite particles, inorganic hollow microspheres, alumina particles, and mixtures thereof.

Through the selection of the fillers or ceramic particles used in the outer core, the thermal properties can be influenced in such a way that a time-delayed destabilization of the inner core takes place as a function of the casting temperature and the amount of heat that is applied. In this way, the velocity of the temperature increase in the inner core, and thus the start of the destruction of the material cohesion in the inner core, can be set by way of the thermal properties of the outer core. This ensures increased compressive strength of the casting core during mold filling, and a destabilization of the core is created after sufficient heat has been applied to the cores.

According to a further preferred embodiment of the casting core according to the invention, the ceramic particles of the outer core and/or the ceramic particles of the inner core have a mean particle diameter of 0.5 μm to 500 μm. The mean particle diameter can be determined by means of laser diffraction.

A further preferred embodiment is characterized in that the binder of the outer core and/or the binder of the inner core are selected from the group consisting of

- inorganic binders, preferably silicate binders, such as silica sols and sodium silicate, phosphate binders, gypsum, and cement;
- organic binders, preferably synthetic resins, such as phenolic resins and furan resins, and protein binders; and
- mixtures thereof.

It is furthermore preferred that the at least one component that has a thermally induced phase change at a temperature in a range of 100° C. to 1500° C. is selected from the group consisting quartz, cristobalite, and mixtures thereof.

In the case of cristobalite, a transformation from tetragonal α-cristobalite (low cristobalite) to cubic β-cristobalite (high cristobalite) takes place in the temperature range of approximately 240 to 275° C. In the case of quartz, a transformation from low quartz to high quartz takes place at approximately 573° C.

A further preferred embodiment of the casting core according to the invention is characterized in that the at least two components having coefficients of thermal expansion that, at 20° C., differ from one another by at least $5\cdot10^{-6}$ $K^{-1}$ are selected from the group consisting of amorphous silica, cordierite, forsterite, magnesium oxide, and mixtures thereof.

Another preferred embodiment of the casting core according to the invention is characterized in that the at least two components having coefficients of thermal expansion that, at 20° C., differ from one another by at least $5\cdot10^{-6}K^{-1}$ comprise at least one first component having a coefficient of thermal expansion in a range of $0.5\cdot10^{\circ}$ $K^{-1}$ to $4.0\cdot10^{-6}K^{-1}$ and at least one second component having a coefficient of thermal expansion in a range of $9.0\cdot10^{\circ}$ $K^{-1}$ to $13.0\cdot10^{\circ}$ $K^{-1}$.

It is preferred in the process that the at least one first component is selected from the group consisting of amorphous silica, cordierite, and mixtures thereof, and/or the at least one second component is selected from the group consisting of forsterite, magnesium oxide, and mixtures thereof.

The at least one first component and the at least one second component are preferably present in equal fractions (for example, fractions in percent by volume) in the inner core.

Preferably, amorphous silica (mean linear coefficient of thermal expansion 0.5 to $0.9\cdot10^{-6}K^{-1}$) and cordierite (magnesium aluminosilicate, mean linear coefficient of thermal expansion 2 to $4\cdot10^{\circ}$ $K^{-1}$) are selected as the filler or component having low thermal expansion. Preferably, forsterite (magnesium silicate, mean linear coefficient of thermal expansion 9 to $11\cdot10^{-6}K^{-1}$) is selected as the filler or component having high thermal expansion, and preferably magnesium oxide (mean linear coefficient of thermal expansion 12 to $13\cdot10^{-6}K^{-1}$) is selected for anhydrous binder systems.

According to a further preferred embodiment of the casting core according to the invention, the outer core and the inner core include pores having a mean pore size of 1 μm to 50 μm, the outer core having a lower porosity than the inner core. The mean pore size and/or the porosity can be determined by means of mercury porosimetry.

A further preferred embodiment is characterized in that the outer core has a thickness of 3 mm to 15 mm, preferably of 3 mm to 10 mm, and particularly preferably of 3 mm to 7 mm. The velocity of the temperature increase in the inner core, and thus the start of the destruction of the material cohesion in the inner core, can be set by way of the thickness of the outer core. This ensures increased compressive strength of the core during mold filling, and a destabilization of the core is created after sufficient heat has been applied to the cores.

It is furthermore preferred that the inner core has a diameter of 5 mm to 100 mm, preferably of 10 mm to 100 mm, and particularly preferably of 15 mm to 100 mm.

The present invention also relates to a method for producing a casting core according to the invention in which

- a first aqueous ceramic suspension, which comprises ceramic particles, a binder, and water, is produced;
- a second aqueous ceramic suspension, which comprises ceramic particles, a binder, and water, is produced;
- the first aqueous ceramic suspension is solidified to form the inner core of the casting core and then dried; and
- the second aqueous ceramic suspension is solidified to form the outer core of the casting core and then dried,
- the ceramic particles of the first aqueous ceramic suspension comprising
  - at least one component that has a thermally induced phase change at a temperature in a range of 100° C. to 1500° C., preferably of 150° C. to 1000° C., particularly preferably of 200° C. to 600° C., and/or
  - at least two components having coefficients of thermal expansion that, at 20° C., differ from one another by at least $5\cdot10^{-6}$ $K^{-1}$, preferably by at least $8\cdot10^{-6}K^{-1}$, and particularly preferably by at least $11\cdot10^{-6}K^{-1}$ and

- wherein the solidification and drying of the first aqueous ceramic suspension are carried out prior to or after the solidification and drying of the second aqueous ceramic suspension.

The solidification of the first and/or second aqueous ceramic suspensions can be carried out in different manners and is ultimately dependent on the binder used in the suspension. With organic binders, curing can be achieved, for example in the cold box process, by way of a reaction with a gaseous component that is fed. In the case of hot box processes, a reaction of the binder components (for example phenolic resin-based or furan resin-based) can be enabled by applying heat. Inorganic alkali sodium silicate-based binders can be solidified by introducing $CO_2$ into the mold body. Binders based on phosphate, gypsum, cement or silica are self-curing.

The solidified first and/or second suspensions are preferably dried at a temperature of 50° C. to 300° C., particularly preferably of 90° C. to 200° C., and/or over a duration of 0.1 to 10 hours, preferably of 0.5 to 5 hours, and particularly preferably of 1 to 3 hours. The drying can take place across multiple steps, wherein, for example, a lower temperature is selected in the first drying step, and a higher temperature is selected in the second drying step.

A preferred variant of the method according to the invention is characterized in that a) the first aqueous ceramic suspension, which comprises ceramic particles, a binder, and water, is poured into a first casting mold which has the negative contour of the inner core of the casting core to be produced, the ceramic particles comprising
   - at least one component that has a thermally induced phase change at a temperature in a range of 100° C. to 1500° C., preferably of 150° C. to 1000° C., particularly preferably of 200° C. to 600° C., and/or
   - at least two components having coefficients of thermal expansion that, at 20° C., differ from one another by at least $5\cdot10^{-6}K^{-1}$, preferably by at least $8\cdot10^{-6}K^{-1}$, and particularly preferably by at least $11\cdot10^{-6}K^{-1}$, b) the first aqueous ceramic suspension present in the first casting mold is solidified to form the inner core of the casting mold, c) the inner core of the casting core is removed from the first casting mold and then dried, d) the dried inner core of the casting core is inserted into a second casting mold which has the negative contour of the casting mold to be produced, and thereafter the second aqueous ceramic suspension, which comprises ceramic particles, a binder, and water, is poured into this second casting mold, e) the second aqueous ceramic suspension present in the second casting mold is solidified to form the outer core of the casting mold, and f) the casting core comprising the inner core and the outer core is removed from the second casting mold and then dried.

A further preferred variant of the method according to the invention is characterized in that a) the second aqueous ceramic suspension, which comprises ceramic particles, a binder, and water, is solidified to form the outer core of the casting core, the outer core including a cavity for the inner core, b) the outer core of the casting mold is dried, and c) the cavity in the outer core of the casting core is filled with the first aqueous ceramic suspension, which comprises ceramic particles, a binder, and water, the ceramic particles comprising
   - at least one component that has a thermally induced phase change at a temperature in a range of 100° C. to 1500° C., preferably of 150° C. to 1000° C., particularly preferably of 200° C. to 600° C., and/or
   - at least two components having coefficients of thermal expansion that, at 20° C., differ from one another by at least $5\cdot10^{-6}K^{-1}$, preferably by at least $8\cdot10^{-6}K^{-1}$, and particularly preferably by at least $11\cdot10^{-6}K^{-1}$, d) the first aqueous ceramic suspension present in the cavity of the outer core is solidified to form the inner core of the casting mold, and e) the inner core present in the cavity of the outer core is dried to form the inner core of the casting mold.

The outer core can be produced in step a) using conventional/known methods, wherein the filler composition can be adapted to the material to be cast.

The present invention shall be described in more detail based on the following examples, without limiting the invention to the specific embodiments and parameters shown here.

Exemplary Embodiment 1

An inorganic bound outer core is produced for use in aluminum casting using conventional/known methods, comprising a cavity for the inner core. The cavity is filled with a filler mixture made of 30 vol % $SiO_2$ (mean particle size 75 μm), 30 vol % forsterite (mean particle size 90 μm), and 40 vol % cristobalite (sieve fraction 63 μm), and silicate binder, and is then dried up to 200° C.

Exemplary Embodiment 2

A sodium silicate-bound inner core having the following filler composition is produced: 25 vol % cordierite (mean particle size 250 μm), 25 vol % forsterite (mean particle size 150 μm), 40 vol % quartz powder (mean particle size 150 μm), and 10 vol % cristobalite (sieve fraction 63 μm). The formed inner core is cured (CO2), inserted into a mold having the geometry of the required core, and surrounded with an inorganically bound outer core, solidified, demolded, and dried.

The invention claimed is:

1. A casting core for casting molds, comprising:

an inner core; and an outer core located around the inner core;

wherein the outer core includes multiple ceramic particles bound using a binder, wherein the inner core includes multiple ceramic particles bound using a binder, and wherein the multiple ceramic particles of the inner core comprise at least one of:

at least one component that has a thermally induced phase change at a temperature in a range of 100° C. to 1500° C., inclusive; or at least two components having coefficients of thermal expansion that, at 20° C., differ from one another by at least $5\cdot10^{-6}K^{-1}$;

wherein the outer core does not comprise any component that has a thermally induced phase change at a temperature in a range of 100° C. to 1500° C., and wherein the outer core does not comprise two components having coefficients of thermal expansion that, at 20° C., differ from one another by at least $5\cdot10^{-6}K^{-1}$.

2. The casting core according to claim 1, wherein the multiple ceramic particles of the outer core are at least one of: zircon sand particles, aluminosilicate particles, mullite particles, inorganic hollow microspheres, alumina particles, or mixtures thereof.

3. The casting core according to claim 1, wherein at least one off the multiple ceramic particles of the outer core or the multiple ceramic particles of the inner core have a mean particle diameter of 0.5 μm to 500 μm, inclusive.

4. The casting core according to claim 1, wherein at least one off the binder of the outer core or the binder of the inner core include at least one of: an inorganic binder, an organic binder, or a mixture thereof .

5. The casting core according to claim 4, wherein the inorganic binder is at least one of: a phosphate binder, gypsum, cement, silica sols, sodium silicate, or another silicate binder.

6. The casting core according to claim 4, wherein the organic binder is at least one of: a protein binder, a phenolic resin, a furan resin, or another synthetic resin.

7. The casting core according to claim 1, wherein the at least one component that has a thermally induced phase change at a temperature in a range of 100° C. to 1500° C., inclusive, is at least one of: quartz, cristobalite, or a mixture thereof.

8. The casting core according to claim 1, wherein the at least two components having coefficients of thermal expansion that, at 20° C., differ from one another by at least $5\cdot10^{-6}K^{-1}$ comprise:

at least one first component having a coefficient of thermal expansion in a range of $0.5\cdot10^{-6}K^{-1}$ to $4.0\cdot10^{-6}K^{-1}$, inclusive, and at least one second component having a coefficient of thermal expansion in a range of $9.0\cdot10^{-6}K^{-1}$ to $13.0\cdot10^{-6}K^{-1}$, inclusive.

9. The casting core according to claim 8, wherein the at least one first component is at least one of: amorphous silica, cordierite, or mixtures thereof, or the at least one second component is at least one of: forsterite, magnesium oxide, or mixtures thereof.

10. The casting core according to claim 1, wherein the outer core and the inner core include multiple pores having a mean pore size of 1 μm to 50 μm, inclusive, and wherein the outer core has a lower porosity than the inner core.

11. The casting core according to claim 1, wherein the outer core has a thickness of 3 mm to 15 mm, inclusive .

12. The casting core according to claim 11, wherein the outer core has a thickness of between 3 mm and 10 mm, inclusive.

13. The casting core according to claim 11, wherein the outer core has a thickness of between 3 mm and 7 mm, inclusive.

14. The casting core according to claim 1, wherein the inner core has a diameter of 5 mm to 100 mm, inclusive.

15. The casting core according to claim 14, wherein the inner core has a diameter of between 10 mm and 100 mm, inclusive.

16. The casting core according to claim 14, wherein the inner core has a diameter of between 15 mm and 100 mm, inclusive.

17. A method for producing a casting core, the method comprising:

producing a first aqueous ceramic suspension, the first aqueous ceramic suspension including multiple ceramic particles, a binder, and water;

producing a second aqueous ceramic suspension, the second aqueous ceramic suspension including multiple ceramic particles, a binder, and water;

solidifying the first aqueous ceramic suspension to form an inner core of the casting core;

drying the solidified first aqueous ceramic suspension;

solidifying the second aqueous ceramic suspension to form an outer core of the casting core; and drying the second aqueous ceramic suspension;

wherein the multiple ceramic particles of the first aqueous ceramic suspension include at least one of:

at least one component that has a thermally induced phase change at a temperature in a range of between 100° C. and 1500° C., inclusive; or at least two components having coefficients of thermal expansion that, at 20° C., differ from one another by at least $5\cdot10^{-6}K^{-1}$;

wherein the outer core does not comprise any component that has a thermally induced phase change at a temperature in a range of 100° C. to 1500° C., and wherein the outer core does not comprise two components having coefficients of thermal expansion that, at 20° C., differ from one another by at least $5\cdot10^{-6}K^{-1}$.

18. The method according to claim 17, further comprising:

pouring the first aqueous ceramic suspension into a first casting mold which has a negative contour of the inner core of the casting core to be produced;

solidifying the first aqueous ceramic suspension present in the first casting mold to form the inner core of the casting mold;

removing the inner core of the casting core from the first casting mold;

drying the inner core of the casting core;

inserting the dried inner core of the casting core into a second casting mold which has the negative contour of the casting mold to be produced;

pouring the second aqueous ceramic suspension into this second casting mold;

solidifying the second aqueous ceramic suspension present in the second casting mold to form the outer core of the casting mold;

removing the casting core comprising the inner core and the outer core from the second casting mold; and drying the casting core.

19. The method according to claim 17, further comprising:

solidifying the second aqueous ceramic suspension to form the outer core of the casting core, the outer core including a cavity for the inner core;

drying the outer core of the casting core;

filling the cavity in the outer core of the casting core with the first aqueous ceramic suspension;

solidifying the first aqueous ceramic suspension present in the cavity of the outer core to form the inner core of the casting core; and drying the inner core.

20. The method according to claim 17, wherein the solidifying and drying of the first aqueous ceramic suspension is performed prior to the solidifying and drying of the second aqueous ceramic suspension.

21. The method according to claim 17, wherein the solidifying and drying of the first aqueous ceramic suspension is performed after the solidifying and drying of the second aqueous ceramic suspension.

22. A casting core for casting molds, comprising:

an outer core; and an inner core;

wherein the outer core includes a first set of ceramic particles bound using a first binder, wherein the outer core does not comprise any component that has a thermally induced phase change at a temperature in a range of 100° C. to 1500° C., wherein the outer core does not comprise two components having coefficients of thermal expansion that, at 20° C., differ from one another by at least $5 \cdot 10^{-6} K^{-1}$, wherein the inner core includes a second set of ceramic particles bound using a second binder, wherein the second set of ceramic particles comprise at least one of: at least one component that has a thermally induced phase change at a temperature of between 100° C. and 1500° C., inclusive, or at least two components having coefficients of thermal expansion that, at 20° C., differ from one another by at least $5 \cdot 10^{-6} K^{-1}$, wherein the first set of ceramic particles are at least one of: zircon sand particles, aluminosilicate particles, mullite particles, inorganic hollow microspheres, alumina particles, or mixtures thereof, wherein at least one of the first set of ceramic particles or the second set of ceramic particles have a mean particle diameter of between 0.5 μm and 500 μm, inclusive, wherein at least one of the binder of the inner core or the binder of the outer core include at least one of an inorganic binder, an organic binder, or a mixture thereof, wherein the at least one component has a thermally induced phase change at a temperature in a range between 100° C. to 1500° C., inclusive, and wherein the at least one component is at least one of quartz, cristobalite, or a mixture thereof.

23. The casting core of claim 22, wherein the outer core and the inner core include multiple pores having a mean pore size between 1 μm to 50 μm, inclusive, and wherein the outer core has a lower porosity than the inner core.

* * * * *